US005867961A

United States Patent [19]

Castaño

[11] Patent Number: 5,867,961

[45] Date of Patent: Feb. 9, 1999

[54] CONTOURED CLADDING SUPPORT APPARATUS AND METHOD

[75] Inventor: Francisco Castaño, Houston, Tex.

[73] Assignee: Geometrica, Inc., Houston, Tex.

[21] Appl. No.: 900,675

[22] Filed: Jul. 25, 1997

[51] Int. Cl.[6] ..... E04H 12/10

[52] U.S. Cl. ..... 52/653.1; 52/653.2; 52/655.1; 52/655.2; 52/648.1; 52/730.4; 52/731.2; 52/732.1; 52/81.3; 403/171; 403/172; 403/176; 403/217

[58] Field of Search ..... 52/730.4, 731.2, 52/732.1, 653.2, 653.1, 655.1, 648.1, DIG. 10, 81.1–81.3, 655.2; 248/188.7; 403/171, 176, 172, 217

[56] References Cited

U.S. PATENT DOCUMENTS

| | | | |
|---|---|---|---|
| 2,895,753 | 7/1959 | Fentiman . | |
| 2,916,109 | 12/1959 | Fentiman . | |
| 2,931,467 | 4/1960 | Fentiman . | |
| 2,964,147 | 12/1960 | Fentiman . | |
| 2,976,968 | 3/1961 | Fentiman . | |
| 3,079,681 | 3/1963 | Fentiman . | |
| 3,081,601 | 3/1963 | Fentiman . | |
| 3,152,819 | 10/1964 | Fentiman . | |
| 3,275,351 | 9/1966 | Fentiman . | |
| 3,309,121 | 3/1967 | Fentiman . | |
| 4,562,682 | 1/1986 | Arvaedi et al. | 52/648 |
| 5,051,019 | 9/1991 | Kohl | 403/171 |
| 5,399,043 | 3/1995 | Plumeyer | 403/171 |

*Primary Examiner*—Carl D. Friedman
*Assistant Examiner*—Yvonne Horton-Richardson
*Attorney, Agent, or Firm*—Haynes and Boone; James R. Bell

[57] ABSTRACT

A cladding support system for a framework including rounded tubular members having an arcuate face and flattened opposite ends inserted into cylindrical hubs. The support element includes an elongated span and opposite end portions each including a terminal end. The span has an arcuate surface in seated engagement with the arcuate face of the tubular member. The end portions of the support element each have a tapered surface coextensive with and angularly disposed relative to the arcuate surface. The tapered surface includes a groove at each terminal end of the support element for receiving the flattened ends of the tubular members. The terminal ends are angular and overhang the cylindrical hubs.

21 Claims, 8 Drawing Sheets

CONTOURED CLADDING SUPPORT APPARATUS AND METHOD

BACKGROUND

The disclosures herein relate generally to space frames and more particularly to a cladding support apparatus and method for forming an unobstructed surface on the space frame for attaching cladding material thereto.

In space frame construction, a generally cylindrical hub includes a plurality of outwardly directed slots extending along the peripheral surface of the hub. The slots have opposed ribbed surfaces. Tubular frame members are flattened and crimped at their opposed ends. The crimped ends include elongated flat surfaces extending outwardly, or away from each other. The crimped ends are ribbed in a pattern which can be mated into engagement with the ribs in the hub slots. In this manner, each end of a tubular frame member may be slidably inserted into a respective hub slot and several tubular frame members may be connected at one end to a hub slot to form a spider, i.e., a hub having a plurality of tubes extending outwardly therefrom, each tube terminating at a free end.

The free end of each tube can be similarly connected to another hub. Thus, a framework of interconnected spiders formed of tubes and hubs can be joined to form a preassembled or modular section of a flat roof, a domed roof; a wall, etc., to be joined with other sections to eventually form a complete structure. The structure, once completed is then covered with a selected cladding which is attached to the structural framework by means of an interfacing cladding support system.

The cladding may be fabric, corrugated steel plates, glass, and other selected materials, and may include combinations of these materials for architectural design purposes. For example, a domed roof may be clad with steel and may include a pattern of glass panels in a portion of the roof which has an aesthetic effect when viewed from the interior of the structure.

It is important that the interfacing cladding support system establish a substantially unobstructed surface for supporting the cladding material so as to provide a smooth cladding surface. As such, the cladding support system is superimposed on the framework to avoid protruding elements of the framework. For example, washers are mounted on opposite ends of the hubs to close the ends of the hub slots and retain the crimped ends of the tubular frame members. These washers are retained by bolts which have ends protruding above the hub and washer. In addition, the support members have uneven surfaces, e.g., the flattened ends of the tubular support members extend above the arcuate surfaces of the tubular support members.

To accommodate these uneven surfaces and protrusions, cladding support systems have been provided which suspend cladding support members in raised relationship spaced from the space frame elements. Such cladding support systems are expensive and difficult to install because of the number of parts required. Also, the spatial relationship between the space frame and the cladding support members is often flexible and as such is not sufficiently rigid for providing satisfactory support for the cladding material.

Therefore, what is needed is an apparatus and method of providing a cladding support system which includes support elements seated directly on the space frame members and which also avoids protrusions and uneven surfaces of the frame members so as to provide an unobstructed surface on the space frame for attaching cladding material thereto.

SUMMARY

One embodiment, accordingly, provides an apparatus and a method for seating cladding support system elements directly on the space frame members for forming an unobstructed surface on the space frame for attaching a cladding material thereto. To this end, a cladding support member includes a support element having an elongated span and opposite end portions each including a terminal end. The support element includes an arcuate surface extending along the span. The end portions of the element each have a tapered surface coextensive with and angularly disposed relative to the arcuate surface. The tapered surface has a groove at the terminal end of the support element.

A principal advantage of this embodiment is that the cladding support member seats directly on tubular members of the space frame. A surface of the cladding support member which engages the space frame, is contoured to accommodate the irregular shape of the space frame surface. Another surface of the cladding support member is at a level which avoids nut and bolt protrusions from the hub and is smooth to provide an unobstructed surface for attaching the cladding material. The result is a rigid, smooth interface between the space frame and the cladding material.

DETAILED DESCRIPTION OF THE PREFERRED EMBODIMENT

Figure 1:
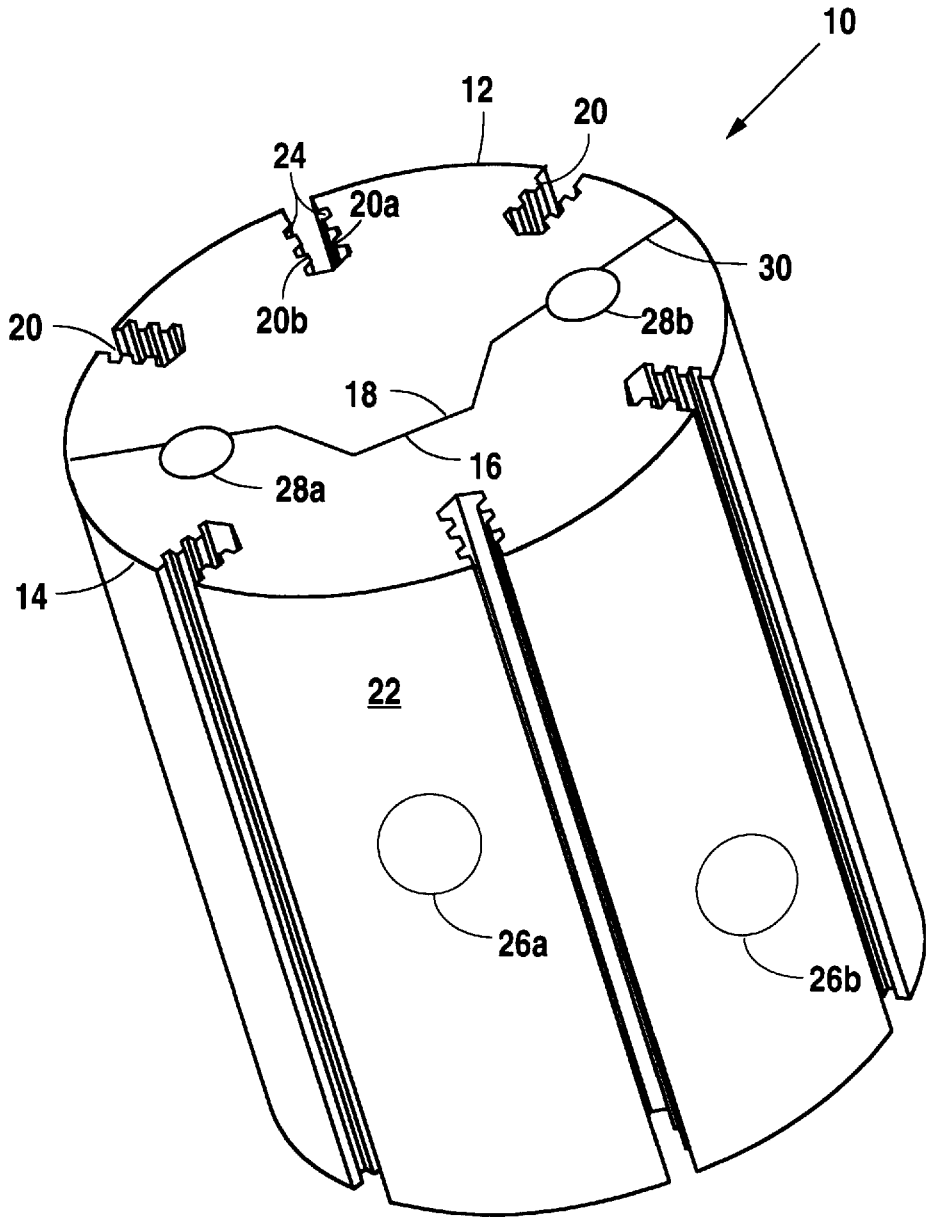
FIG. 1 is an isometric view illustrating an embodiment of a split hub disclosed herein.

Referring now to the drawings, FIG. 1 illustrates a split separable joint comprising a substantially cylindrical hub, generally designated 10, including a first hub portion 12 and a second hub portion 14. A keyed surface 16 on portion 12 is mated to abut a keyed surface 18 on portion 14. This insures that hub portions 12 and 14 will nest together as a unit. A plurality of radially directed slots 20 are formed to extend axially along a peripheral surface 22 of hub 10. Slots 20 are keyed with a plurality of ribs 24 on a pair of opposed slot sides 20*a* and 20*b* which face inwardly or toward each other. It should be noted that hub 10 may be of a shape other than cylindrical. Slots 20 may also be outwardly directed without being radially directed.

Figure 2:
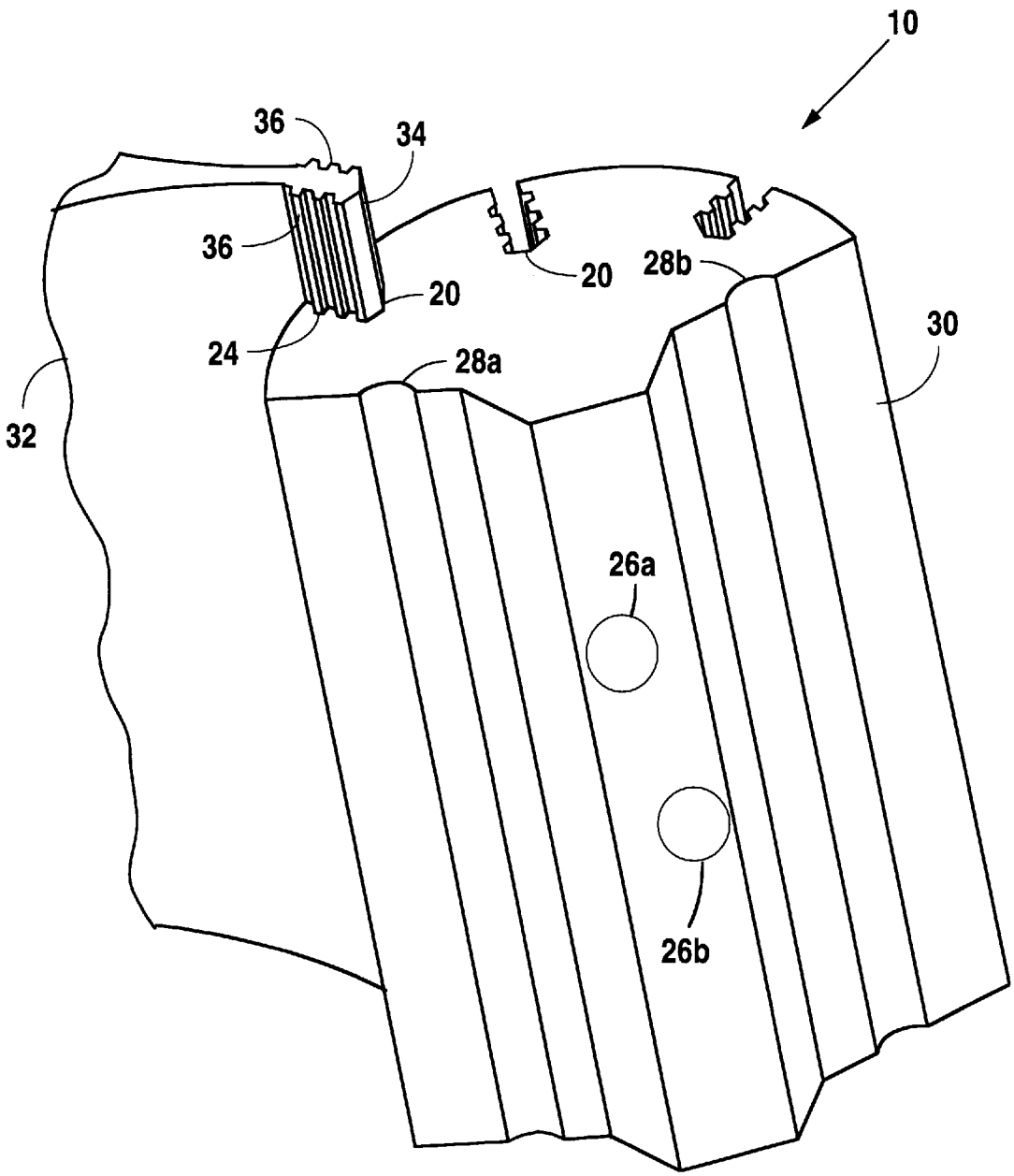
FIG. 2 is an isometric view illustrating an embodiment of a portion of a split hub having a tubular support member connected therewith.
Figure 3:
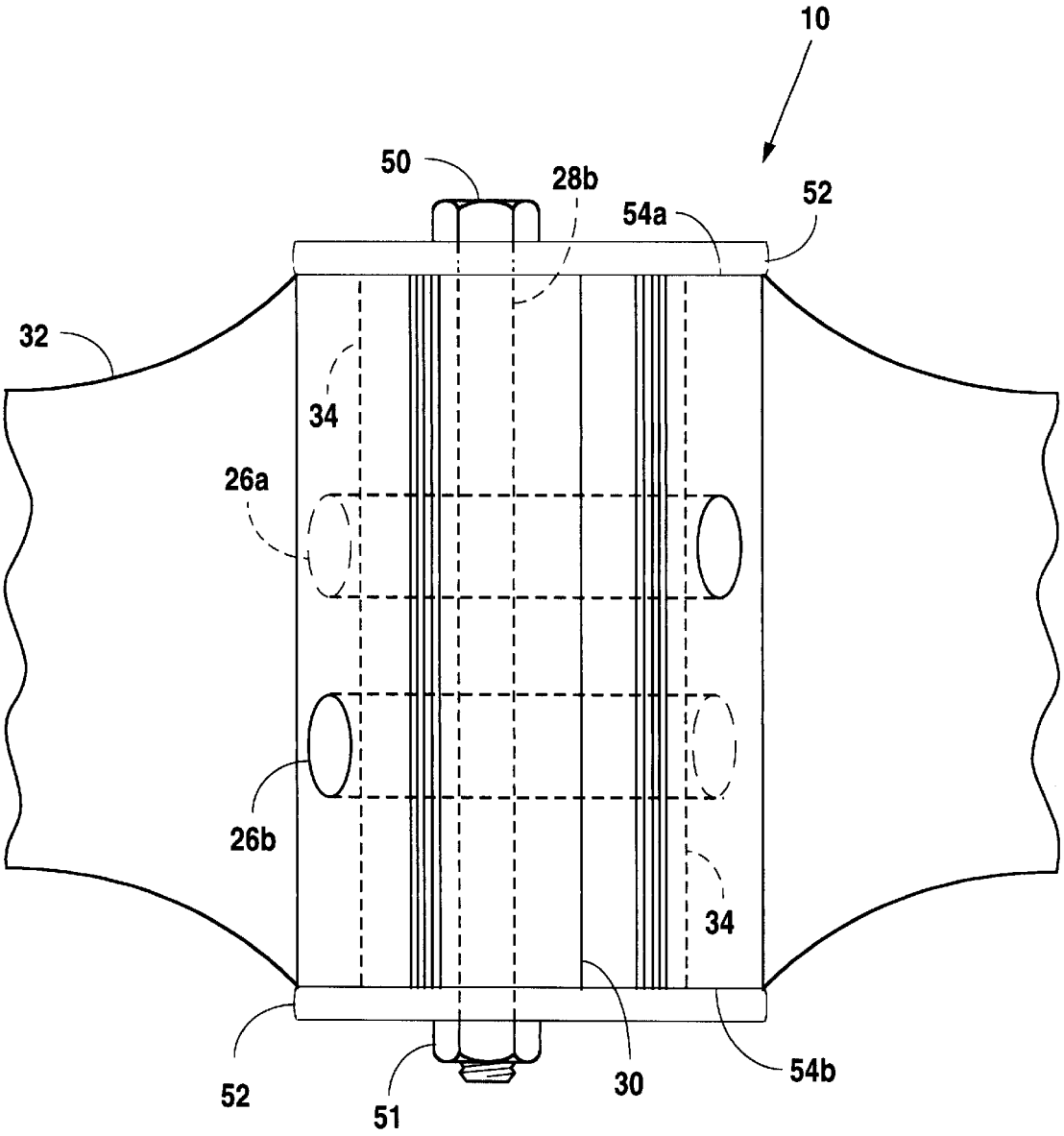
FIG. 3 is a side view illustrating an embodiment of the split hub fully assembled including endplates for retaining tubular support members in their respective slots.

Hub 10 includes a first pair of bores 26*a*, 26*b* formed diametrically therethrough and a second pair of bores 28*a*, 28*b* formed axially therethrough. FIGS. 1, 2 and 3 illustrate that axial bores 28*a* and 28*b* are spaced apart from each other along an interface 30 between keyed surfaces 16 and 18. Interface 30 axially splits hub 10 into portions 12 and 14. Also, it can be seen that a portion of each bore 28*a*, 28*b* is formed in hub portion 12 and a complimentary portion of each bore 28*a*, 28*b* is formed in mating hub portion 14. FIGS. 1–6 illustrate that bores 26*a*, 26*b* are axially spaced apart and are also radially offset so that the axes of bores 26*a*, 26*b* crisscross within hub 10 as viewed in FIGS. 4–6. Bores 26*a*, 26*b* do not need to be radially offset, but may be axially spaced and aligned, i.e. one directly above or below the other.

Slots 20 are provided for receiving and retaining a plurality of tubular structural members 32, FIGS. 2 and 3 therein. Members 32 may be slidably retained in slots 20. Opposite keyed ends 34, FIG. 2, of members 32 are flattened and have a plurality of outwardly facing ribs 36 crimped into ends 34 for mating engagement with inwardly facing ribs 24 of slots 20.

Figure 6:
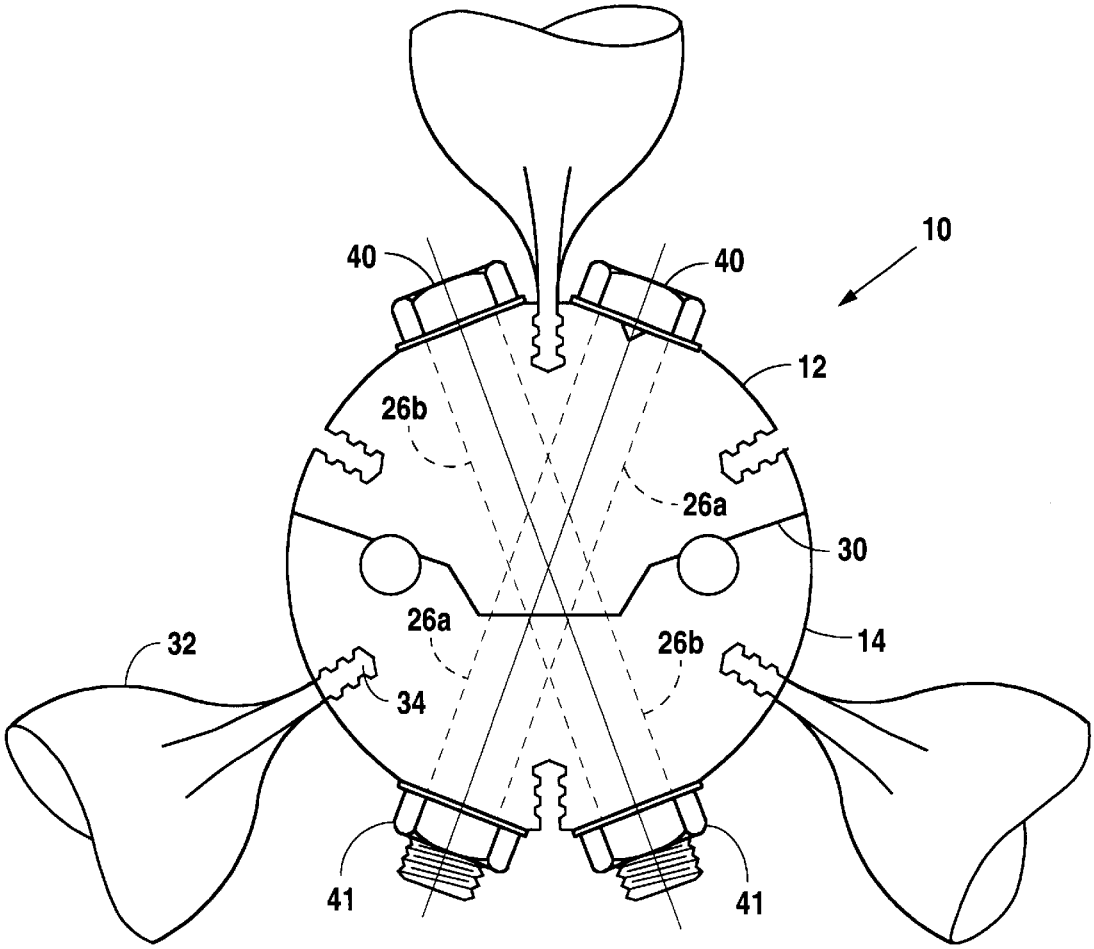
FIG. 6 is a plan view illustrating an embodiment of a split hub assembled and connected by bolts and having tubular support members engaged therewith.

Means such as bolts 40 and nuts 41, FIG. 6, are provided for fastening and retaining first hub portion 12 and second hub portion 14 in unitary keyed engagement. Bolts 40 extend through diametrically extending bores 26*a*, 26*b*. It can be seen from FIGS. 1–6 that each bore 26*a* and 26*b* is partially formed in each hub portion 12, 14 so that when hub portions 12, 14 are mated to form interface 30, the respective portions of bores 26*a*, 26*b* are aligned to receive bolts 40. The criss-cross and axially displaced pattern of bolts 40 adds stability to the unitary structure of hub 10.

In order to retain tubular structural members 32 in hub 10, a pair of bolts 50, and nuts 51, only one of which is shown in FIG. 3, are provided for extending through axially extending bores 28*a*, 28*b*. A pair of endplates or washers 52 are maintained in abutment with opposed ends 54*a*, 54*b* of hub 10 by bolts 50 and nuts 51. This captures ends 34 of structural members 32 within slots 20.

Figure 4:
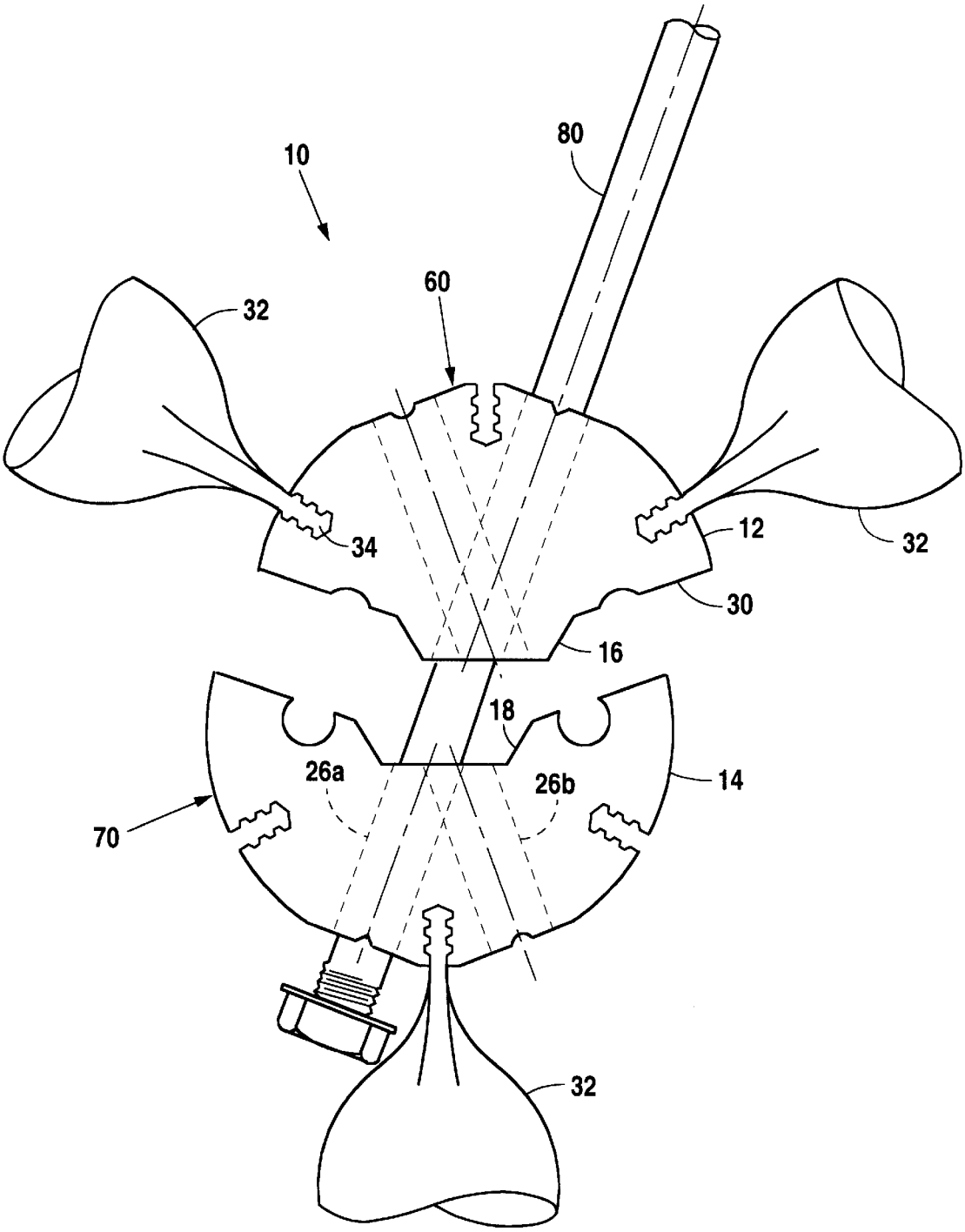
FIG. 4 is a plan view illustrating an embodiment of separated portions of the split hub having an alignment member and tubular support members engaged therewith.
Figure 5:
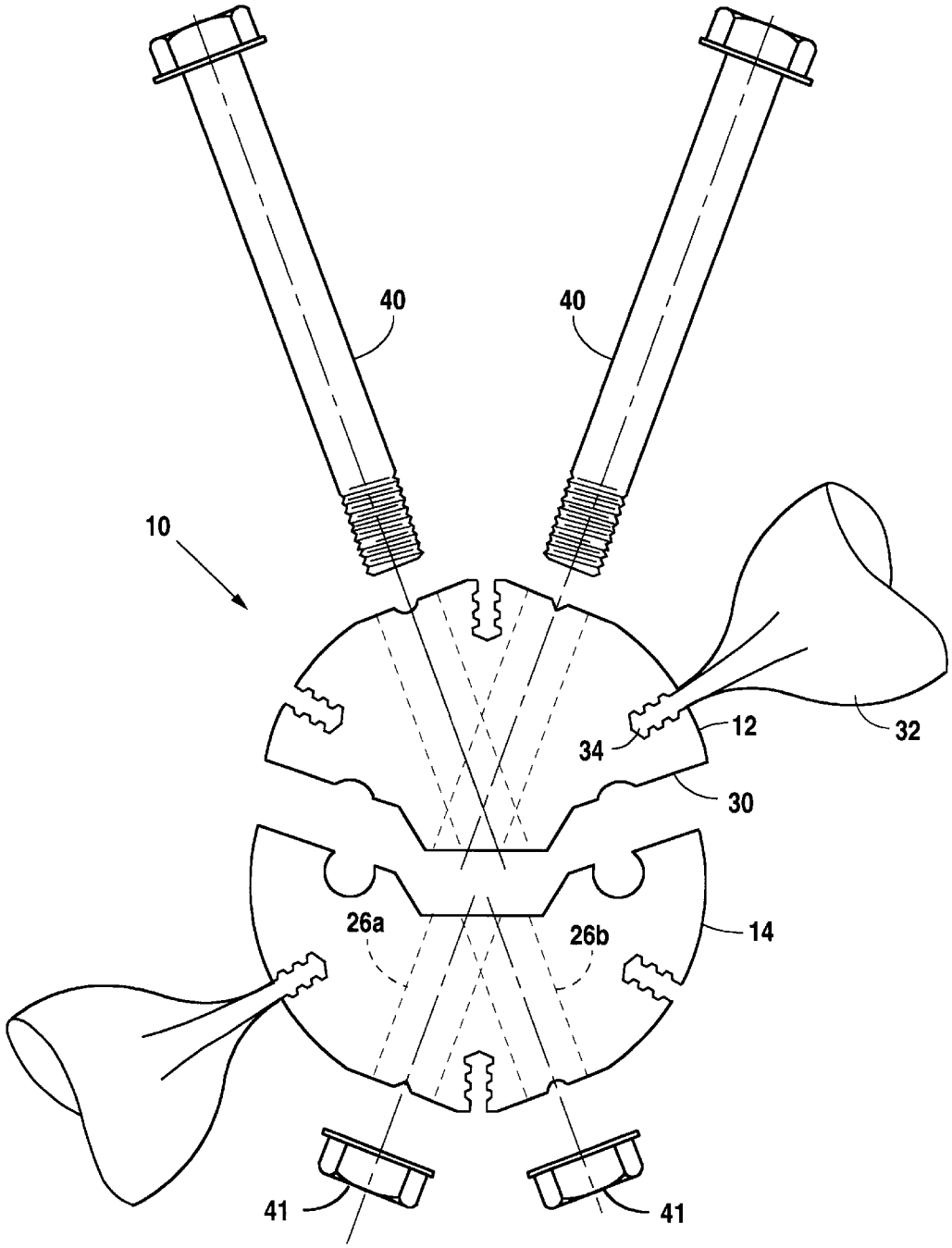
FIG. 5 is a plan view illustrating an embodiment of separated portions of the split hub having tubular support members engaged therewith and attachment bolts positioned for engagement.

A first section of a frame 60, FIG. 4, includes at least one hub portion 12 connected with at least one structural member 32. A second section of a frame 70, also includes at least one hub portion 14 connected with at least one structural member 32. When it is desired to join the first and second frame sections 60, 70, respectively, hub portion 12 and hub portion 14 may be aligned for mating engagement by using an alignment device such as a steel rod 80, or the like extended through bore 26*a*, for example. The sections 60, 70 can then be drawn together along rod 80 until faces 16 and 18 mate to form interface 30. One of the bolts 40 and nuts 41, illustrated in FIGS. 5 and 6, can then be inserted into bore 26*b* and fastened to retain hub portions 12 and 14 together. Rod 80 can then be removed and another bolt 40 and nut 41 can be inserted to replace rod 80 in bore 26*a* and fastened to stabilize hub portion 12 and 14 together as illustrated in FIG. 6. End plates 52, FIG. 3, can then be retained in place by bolts 50 and nuts 51 to retain the structural members 32 connected to hub 10.

When frame sections 60 and 70, FIG. 6, are joined and a space frame is completed, cladding can be added. In order to accomplish this, a cladding support system is mounted on the space frame to provide an unobstructed surface to which a selected cladding is attached. As such, the surface must compensate for high and low points along the framework caused by the varying shape of the tubular structural members 32, FIG. 3, having flattened ends 34 and also caused by the protruding bolts 50 of hubs 10.

Figure 7:
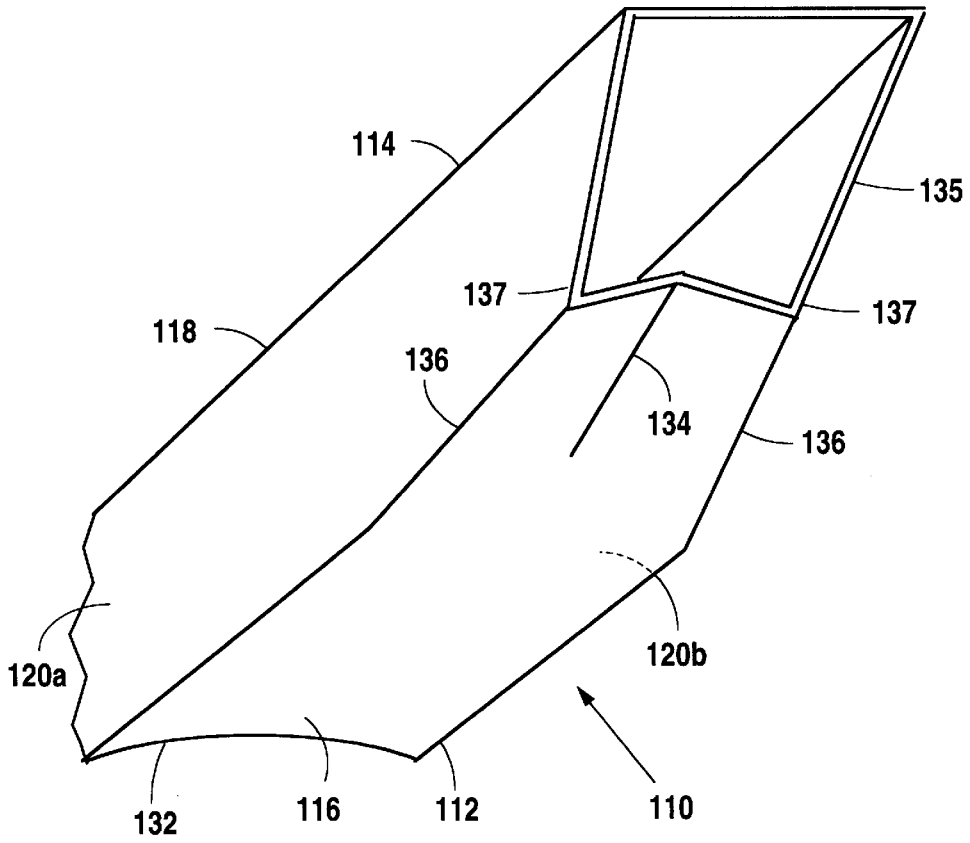
FIG. 7 is an isometric view partially illustrating an embodiment of a contoured cladding support member.

Referring to FIG. 7, a cladding support element is generally designated 110 and includes an elongated span 112 and opposite end portions 114, only one of which is shown. Support element 110 is preferably a section of square or rectangular steel tubing having a first surface 116, a second surface 118 and a pair of opposed side surfaces 120*a* and 120*b*. First surface 116 is contoured to rest directly on tubular support member 32, which has a generally arcuate peripheral surface 23, see FIG. 9. However, tubular member 32 includes flattened end 34 as stated above. As such, the profile of tubular support member 32 is changed at the ends 34 and is raised relative to surface 23. Furthermore, the flattened ends 34 are non-circular, see FIGS. 8 and 10.

As a result, first surface 116 requires a variable contour so as to be able to rest directly on tubular member 32 along span 112 and end portions 114. In order to accomplish this, the span portion 112 of surface 116 of support element 110 has a curvature 132, FIG. 7, which engages peripheral surface 23. Curvature 132 transitions to a "V" shaped groove 134 at end portion 114 so as to engage raised flattened ends 34 of support member 32. In addition, sides 120*a* and 120*b* and surface 116 include a tapered portion 136 at end portion 114 to accommodate raised ends 34 of support member 32. see FIG. 9. Also, sides 120*a*, 120*b* have an angular terminal end 135, FIG. 7, extending from first surface 116 to a substantially flat second surface 118. In this manner, second surface 118 overhangs first surface 116, FIG. 8. Furthermore, sides 120*a*, 120*b* are tapered inwardly at 137, FIG. 7, toward each other adjacent end portion 114 to accommodate the crimped end 34 of support member 32.

Figure 8:
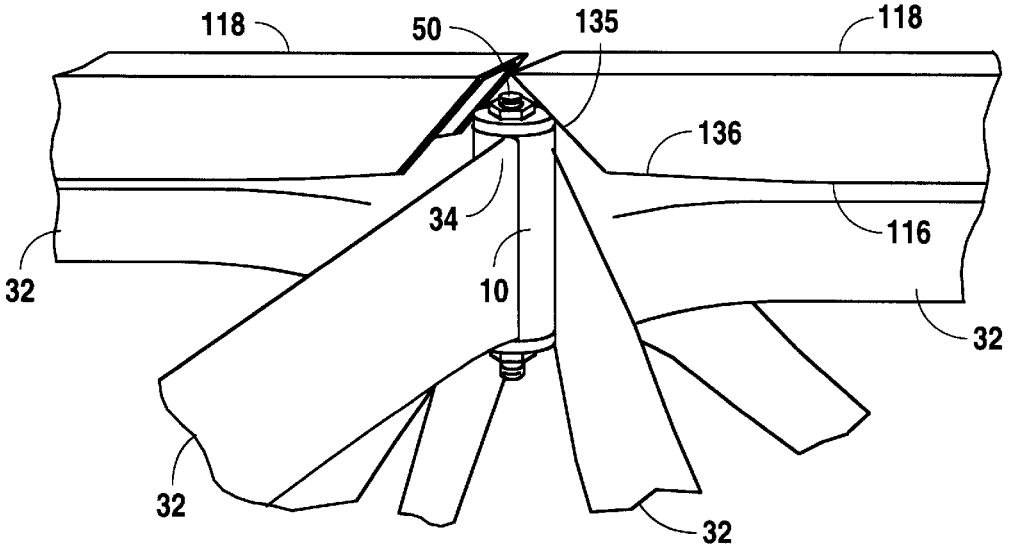
FIG. 8 is an isometric view partially illustrating tubular support members connected to a hub and contoured cladding support members mounted directly on the tubular members.
Figure 9:
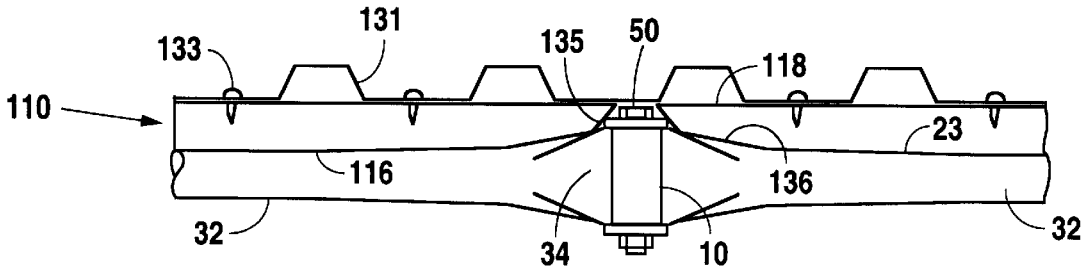
FIG. 9 is a side view partially illustrating tubular support members connected to a hub, contoured cladding support members mounted directly on the tubular members and cladding material attached to the cladding support members.
Figure 10:
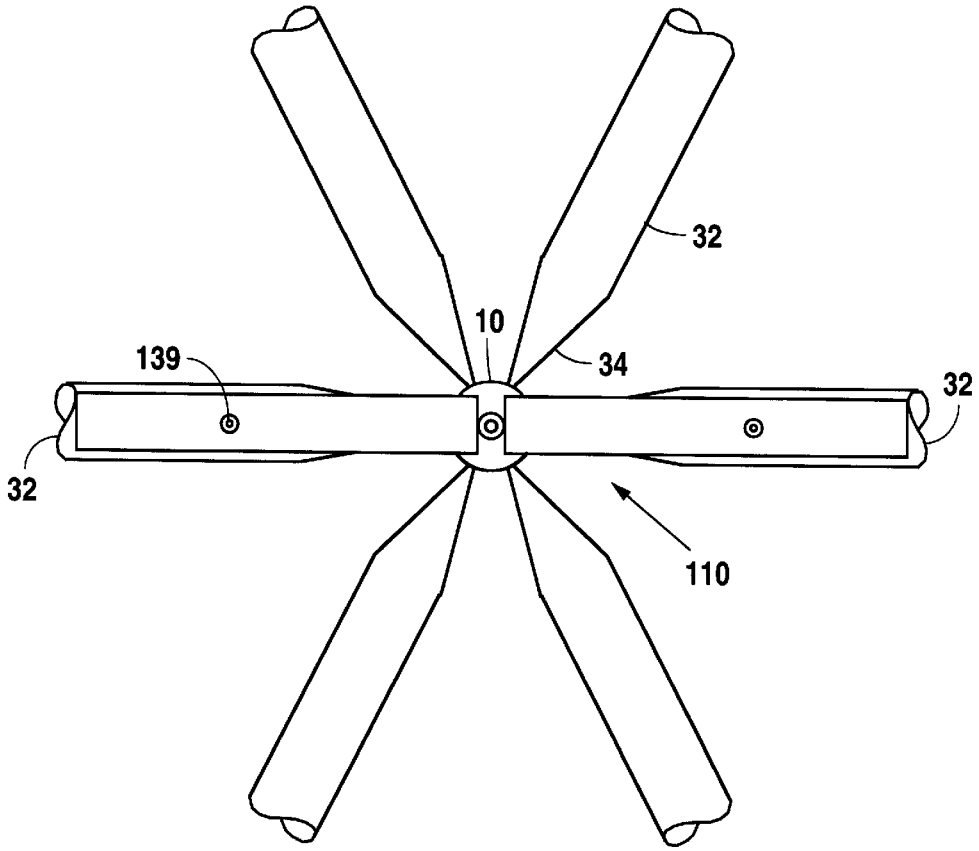
FIG. 10 is a top view illustrating tubular support members connected to a hub and contoured cladding support members mounted on the tubular members.

In this manner, as illustrated in FIG. 8, an unobstructed cladding support system is provided by attaching a pattern of cladding support elements 110 directly to tubular support members 32 by appropriate fasteners 139, FIG. 10. The contoured lower or first surface 116 accommodates the variations in support member 32. The flat or upper surface 118 provides an interface free of obstructions for supporting, for example, a corrugated steel cladding material, 131, FIG. 9, which is mounted thereon by appropriate fasteners 133. The angular, terminal end 135 accommodates the hub 10, and the overhanging second surface 118 at the angular, terminal end 135 also covers the bolt 50, protruding from hub 10.

As it can be seen, the principal advantages of these embodiments are that the cladding support members seat directly on tubular members of the space frame. A lower surface of the cladding support member which engages the space frame, is contoured to accommodate the irregular shape of the space frame surface. An upper surface of the cladding support member is at a raised level which avoids nut and bolt protrusions from the hub and is smooth to provide an unobstructed surface for attaching the cladding material. The result is a rigid, smooth interface between the space frame and the cladding material.

Although illustrative embodiments have been described, a wide range of modifications, change and substitution is contemplated in the foregoing disclosure and in some instances, some features of the embodiments may be employed without a corresponding use of other features.

Accordingly, it is appropriate that the appended claims be construed broadly and in a manner consistent with the scope of the embodiments disclosed herein.

What is claimed is:

1. A cladding support member comprising:

a support element having an elongated span and opposite end portions each including a terminal end, the support element including an arcuate surface extending along the span, the end portions of the element each having a tapered surface coextensive with and angularly disposed relative to the arcuate surface, the tapered surface including a groove adjacent each terminal end of the support element.

2. The cladding member as defined in claim 1 wherein each terminal end is angular.

3. The cladding member as defined in claim 1 wherein the groove is "V" shaped.

4. The cladding member as defined in claim 1 wherein the support element is a rectangular tube.

5. The cladding member as defined in claim 4 wherein the arcuate surface is a first surface, the tube including a second surface opposite the first surface and spaced from the first surface.

6. The cladding member as defined in claim 5 wherein the second surface is flat.

7. The cladding member as defined in claim 6 wherein the second surface is longer than the first surface.

8. The cladding member as defined in claim 6 wherein the second surface overhangs the first surface at the terminal ends.

9. The cladding member as defined in claim 8 wherein the terminal ends are angular and extend between the first and second surfaces.

10. A cladding support system comprising:

a framework including rounded tubular members having an arcuate face and flattened opposite ends, the ends having ribs inserted in ribbed slots formed in cylindrical hubs, the hubs having washers at each opposite end thereof for retaining the flattened ends in the slots and having a fastener protruding beyond the washers for securing the washers on the hub ends; and a cladding support element having an elongated span and opposite end portions each including a terminal end, the span having an arcuate surface in seated engagement with the arcuate face of the tubular member, the end portions of the element each having a tapered surface coextensive with and angularly disposed relative to the arcuate surface, the tapered surface including a groove at each terminal end of the support element for receiving the flattened ends of the tubular members.

11. The cladding support system as defined in claim 10 wherein each terminal end is angular.

12. The cladding support system as defined in claim 10 wherein the groove is a "V" shaped groove.

13. The cladding support system as defined in claim 10 wherein the support element is a rectangular tube.

14. The cladding support system as defined in claim 13 wherein the arcuate surface is a first surface, the rectangular tube including a second surface opposite the first surface and spaced from the first surface.

15. The cladding support system as defined in claim 14 wherein the second surface is flat.

16. The cladding support system as defined in claim 15 wherein the second surface is longer than the first surface.

17. The cladding support system as defined in claim 15 wherein the second surface overhangs the first surface at the terminal ends.

18. The cladding support system as defined in claim 17 wherein the terminal ends are angular and extend between the first and second surfaces.

19. The cladding support system as defined in claim 18 wherein the second surface overhangs the protruding fastener.

20. A method of mounting a cladding support system on a framework including tubular support members having an arcuate face and having flattened ends connected in hub members, the hub members having retaining bolts protruding therefrom, comprising the steps of:

forming a cladding support element with an elongated span and opposite end portions;

forming an arcuate first surface along the span;

forming a flat second surface in raised relationship to and overhanging the first surface;

forming terminal ends of the support element to extend angularly from the first surface to the overhanging second surface;

forming a groove in the first surface adjacent each terminal ends;

forming a taper on the first surface adjacent each groove;

seating the support element on the tubular support member so that the arcuate first surface of the support element engages the arcuate face of the support member, so that the flat second surface is positioned above the protruding bolts and overhangs the hub, and so that the grooves and tapers engage the support element adjacent the opposite end portions; and securing the support element on the tubular support member.

21. A cladding support system comprising:

a hub including a first portion and a second portion;

a keyed surface on the first portion and a mating keyed surface on the second portion;

a keyed slot formed in a peripheral surface of each portion of the hub;

means for retaining the first and second hub portions in unitary keyed engagement;

rounded tubular members having an arcuate face and flattened opposite ends, the ends being inserted into the keyed slots of each portion of the hub; and a cladding support element extending axially along at least one tubular member, the support element having an elongated span and opposite end portions each including a terminal end, the span having an arcuate surface in seated engagement with the arcuate face of the tubular member, the end portions of the element each having a tapered surface coextensive with and angularly disposed relative to the arcuate surface, the tapered surface including a groove at each terminal end of the support element for receiving the flattened ends of the tubular members.

* * * * *